United States Patent [19]

McIntyre

[11] Patent Number: 4,738,286

[45] Date of Patent: Apr. 19, 1988

[54] FLUID COLLECTION AND DISPOSAL APPARATUS

[76] Inventor: Jonothon M. W. McIntyre, 13535 Valerio St., Apt. 113, Van Nuys, Calif. 91405

[21] Appl. No.: 31,041

[22] Filed: Mar. 27, 1987

Related U.S. Application Data

[62] Division of Ser. No. 878,025, Jun. 24, 1986, Pat. No. 4,705,248.

[51] Int. Cl.[4] ..... B65B 67/12

[52] U.S. Cl. ..... 141/10; 493/409

[58] Field of Search ..... 141/10, 314, 316, 337, 141/338, 390, 391; 184/1.5, 106; 220/404; 248/150, 152, 94, 97, 99, 100, 101; 493/93, 137, 138, 394, 405, 409

[56] References Cited

U.S. PATENT DOCUMENTS

| | | | |
|---|---|---|---|
| 3,595,507 | 7/1971 | Kurlander | 248/97 |
| 3,610,560 | 10/1971 | Harris | 248/97 |
| 3,983,914 | 10/1976 | Benson | 141/390 |
| 4,022,257 | 5/1977 | O'Connell | 141/314 X |
| 4,064,969 | 12/1977 | Black | 248/99 X |
| 4,332,282 | 6/1982 | Strange | 141/1 |
| 4,338,979 | 7/1982 | Dow | 141/10 |
| 4,485,853 | 12/1984 | Gunderson | 141/1 |
| 4,512,463 | 4/1985 | Ward | 141/337 X |
| 4,610,039 | 9/1986 | Stern | 141/390 X |

*Primary Examiner*—Mark J. Thronson

*Attorney, Agent, or Firm*—Kelly, Bauersfeld & Lowry

[57] ABSTRACT

A device which may be conveniently utilized to collect oil drained from an engine crankcase includes a fluid impermeable plastic bag and a rigid drain stand. The drain stand is designed to hold the bag below the oil drain in a manner facilitating flow of oil into the bag while simultaneously preventing larger objects, such as the drain plug, from also falling into the bag. This drain stand is further preferably constructed of a single sheet of corrugated fiberboard material which may be shipped or sold in a flattened or collapsed configuration, and then unfolded and assembled with the bag by the end user. A unique locking mechanism is provided for joining portions of the corrugated fiberboard sheet without adhesives to form a strong, rigid structure. After the oil has been completely drained into the bag, the bag can be removed from the drain stand, sealed, and then disposed of in an ecologically sound and safe manner.

17 Claims, 4 Drawing Sheets

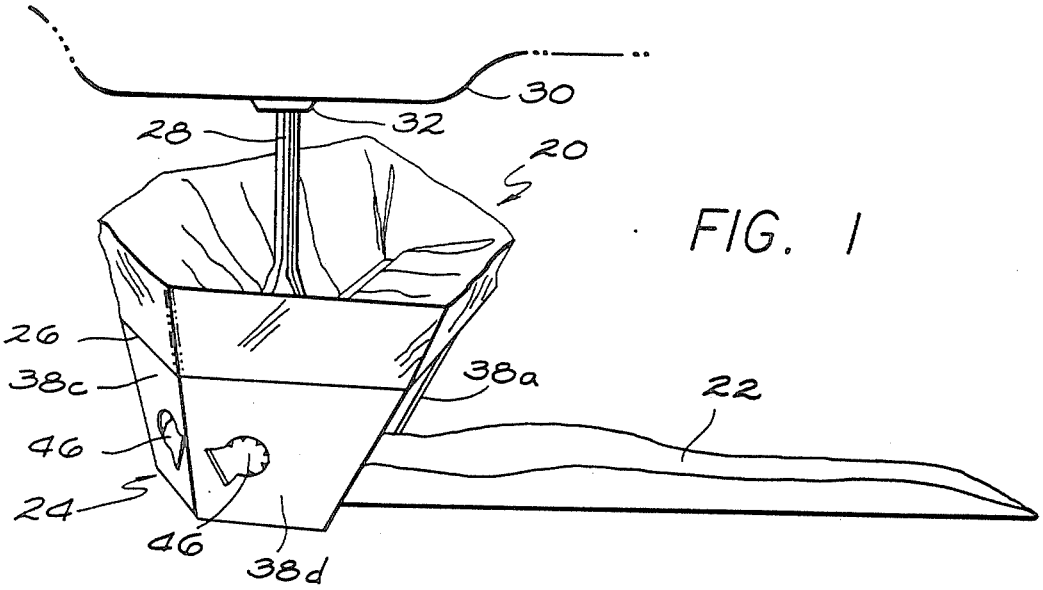
FIG. 1
FIG. 2
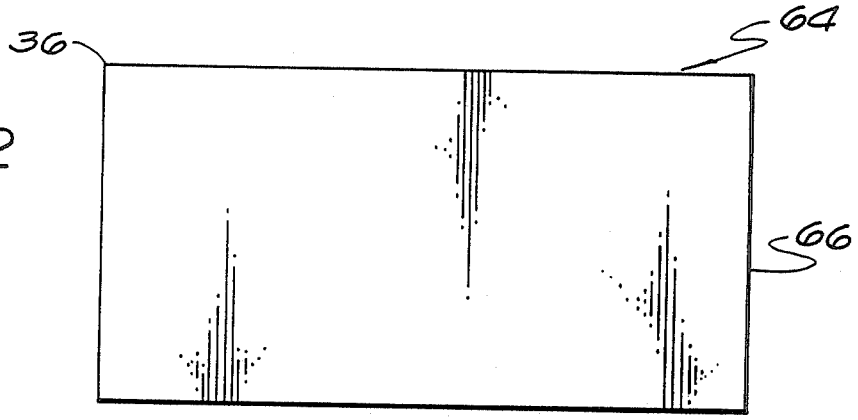
FIG. 3
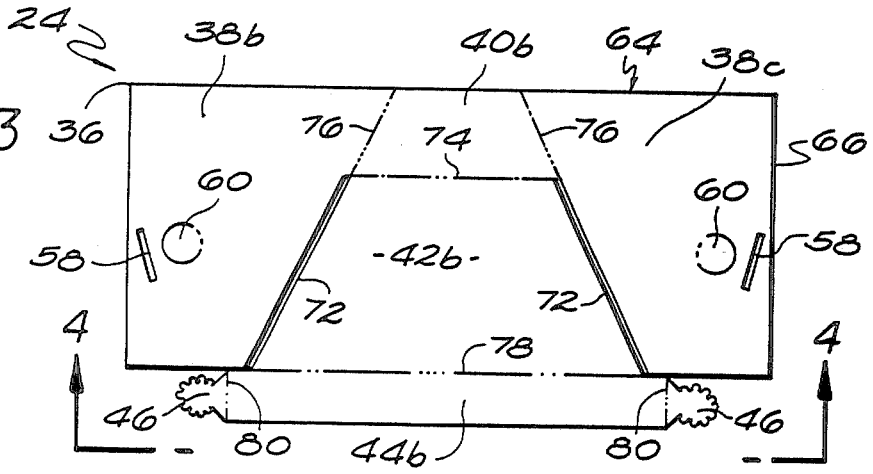
FIG. 4
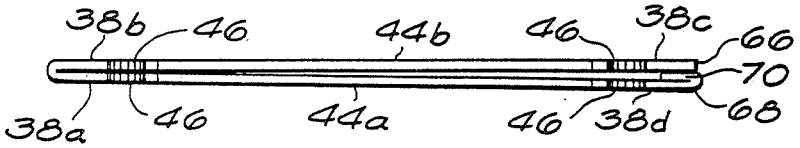

FIG. 5
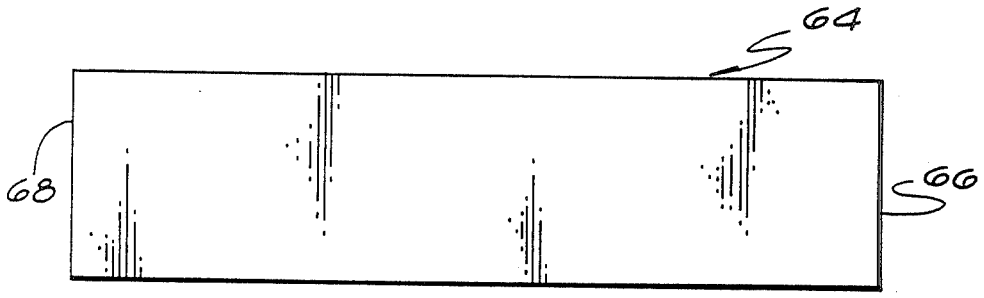
FIG. 6
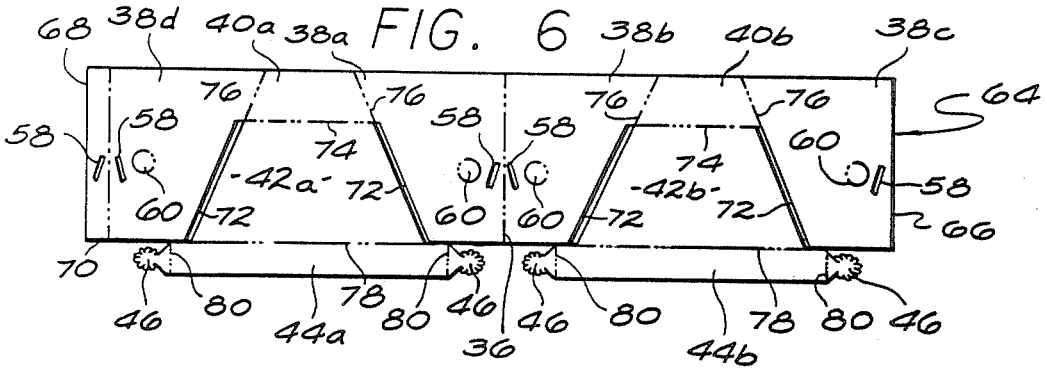
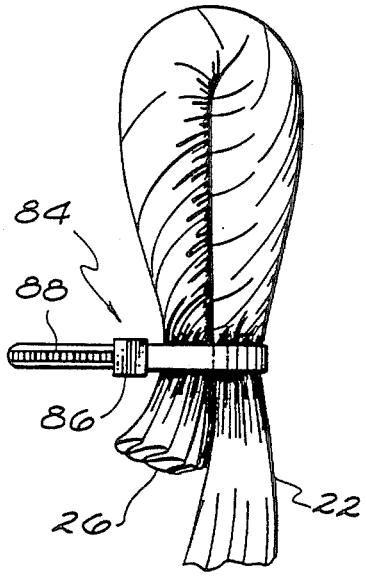
FIG. 16
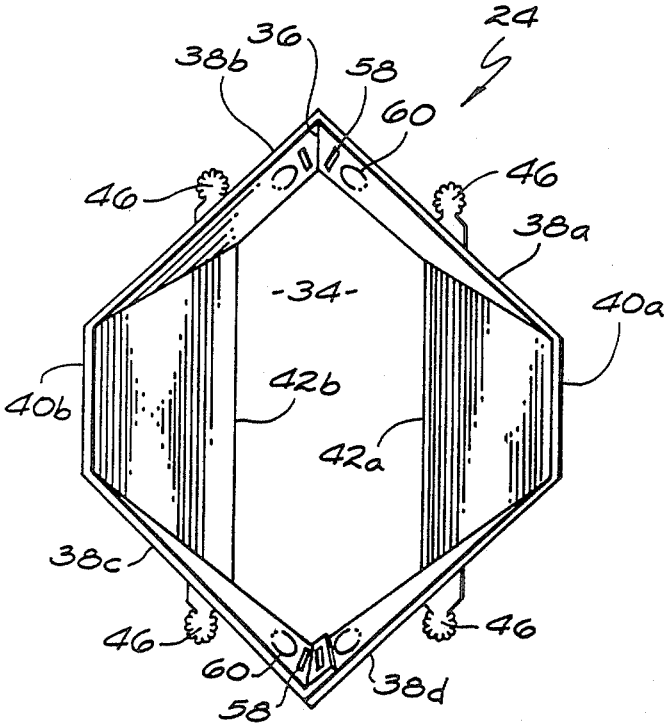
FIG. 7

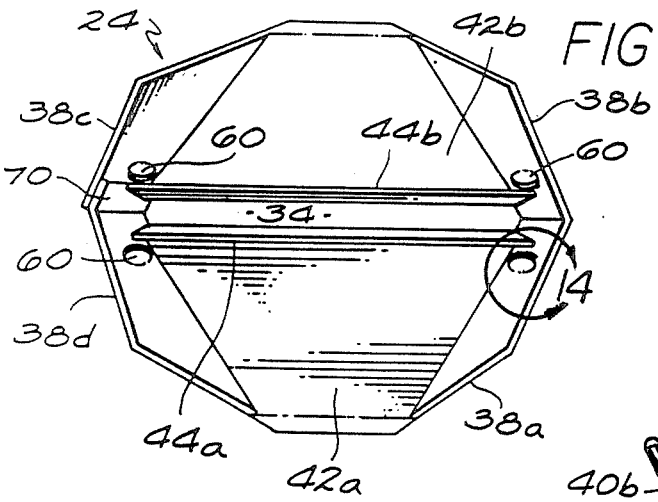
FIG. 10
FIG. 11
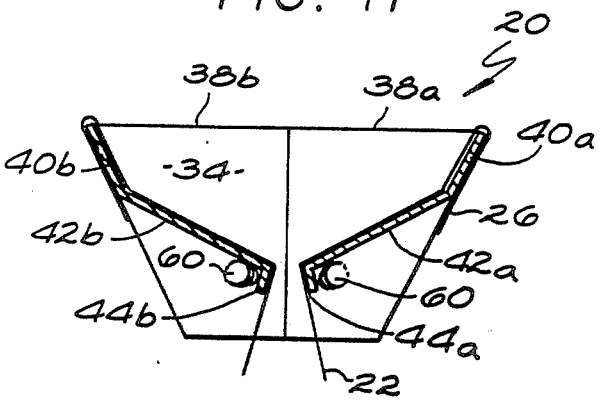
FIG. 12
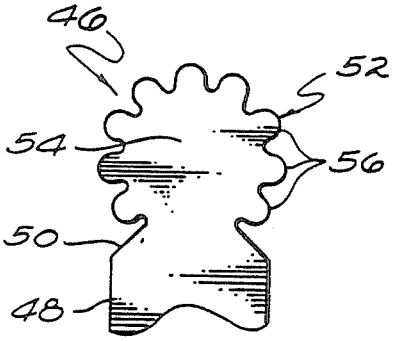
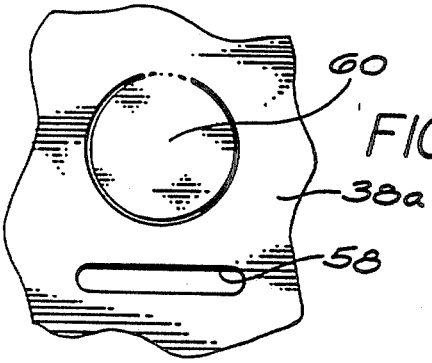
FIG. 13
FIG. 14
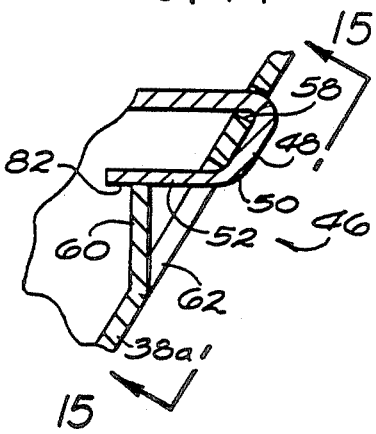
FIG. 15
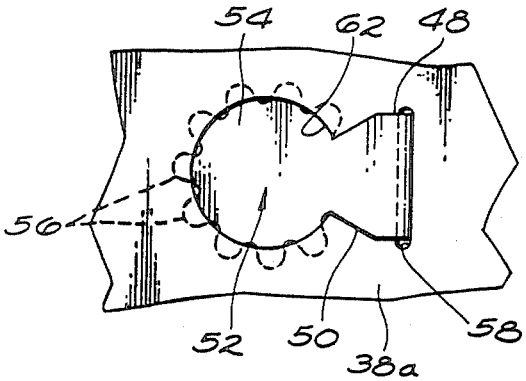

FLUID COLLECTION AND DISPOSAL APPARATUS

This is a division of application Ser. No. 06/878,025, filed Jun. 24, 1986, now U.S. Pat. No. 4,705,248.

BACKGROUND OF THE INVENTION

This invention relates generally to the collection and disposal of fluids, and, more specifically, to lightweight and easy to manufacture devices utilized to collect fluids, such as hazardous wastes, and which also provide for convenient disposal of the collected fluids.

Fluid collection and disposal systems often resemble devices utilized to collect engine crankcase oil. In the most basis form, fluid collection devices are constructed to simply form a collection basin or container for retaining the drained fluids within a confined area.

Since many of the fluids routinely drained from machines and the like, are classified as hazardous wastes, the need has arisen for systems which can accommodate disposal of such hazardous wastes in a clean, efficient and ecologically sound manner. In this regard, gasoline service stations now routinely accept used engine crankcase oil, and they often provide a dedicated waste oil barrel for this purpose. A problem exists for the home mechanic, however, in transporting used oil to the recycling bin or station.

In an attempt to overcome this problem, various devices have been designed which funnel the used oil into an encloseable container. For example, one proposed solution has been to provide a raised collection reservoir which can be situated beneath a drain plug for receiving oil draining from a crankcase. The bottom surface of this collection reservoir slopes downwardly to a central aperture where the oil is funnelled into a plastic collection bag. After fluid drainage is complete, this collection bag can be sealed and then transported to the recycling bin.

Another attempt to solve the problem of transporting used oil to a recycling center involves the provision of a rigid container having the equivalent of an oil pan formed in the side thereof. In use, this container is laid on its side with the oil pan facing upwardly and placed immediately below the drain. A container drain plug is removed from an aperture at the bottom of the integral oil pan, and oil impinging onto the oil pan surface is funnelled through the aperture into the rigid container. After collecting the oil within the container, the plug can be replaced and the oil transported inside of the container to the recycling station for safe disposal.

Although the foregoing represent improvements to the basic open top collection basin, problems exist which make present collection and disposal systems less than ideal. For example, in both of the above discussed devices, the oil pan itself should be cleaned after use. This is often a very messy and objectionable task. Further, the devices presently available tend to be bulky, difficult to use, and to lack a desired level of consumer acceptance which would place them in widespread use.

Accordingly, there has been a need for a fluid collection and disposal apparatus which is inexpensive, convenient to use, and provides a safe and efficient means for properly disposing of fluids such as engine crankcase oil. Additionally, there has been a need for a device which eliminates clean-up of parts after the fluid has been drained, and which provides apparatus for conveniently transporting the drained fluid to a recycling station. A need further exists for a fluid collection and disposal apparatus which can be shipped in a flat condition, unfolded quickly for use, constructed of a material such as corrugated fiberboard, and ultimately thrown away after use. Moreover, a need exists for such an apparatus which can be utilized by manufactures to promote other related goods, such as motor oil, in an inexpensive manner, and which appeals to the public. The present invention fulfills these needs and provides other related advantages.

SUMMARY OF THE INVENTION

The present invention resides in an improved fluid collection and disposal apparatus which provides a safe and efficient means for transporting and disposing fluids such as used engine crankcase oil. The novel apparatus of the present invention comprises generally a fluid impermeable bag-like enclosure means for receiving and holding fluids to be collected, and a collapsible drain stand for holding the enclosure means in a manner facilitating flow of fluids to be collected into the enclosure means.

The drain stand includes means for engaging an open end of the enclosure means to hold it in an open, fluid receiving position. Further, means are provided for funneling fluid drained through the enclosure means open end to the remainder of the enclosure means in a manner preventing larger solid objects from entering the enclosure means. Moreover, the drain stand includes means for positioning the engaging means and the funneling means to ensure that substantially all of the fluids to be collected drain into the enclosure means.

In a preferred form of the invention, the drain stand is constructed from a generally rectangular piece of flat, rigid base material folded along a mirror-image fold line perpendicular to the long axis of the base material. The mirror-image fold line provides a reference from which the base material is cut and folded, whereby a cut or fold on one side of the mirror-image fold line is generally duplicated on the other side of the mirror-image fold line. The free ends of this base material are secured to one another, and the two oppositely facing sides of the base material are separated from one another except for attachment at the mirror-image fold line and the secured free ends. This separation creates a definable drain stand interior.

The bottom side of the base material is cut to form, on each side of the mirror-image fold line, a pair of drain stand legs, an enclosure means guide panel, and a locking tab at each end of the guide panel. The mid-section of the base material is further cut to form, again on each side of the mirror-image fold line, an inner support panel connected at its upper end to the remainder of the base material but separated along its sides from the base material. The inner support panel is connected at its lower end to the guide panel.

The inner support panels are bent upwardly into the drain stand interior to create the aforementioned means for funneling fluid, and then the inner support panels are secured in a desired position by engaging the locking tabs with means for securing the locking tabs to the remainder of the base material. More specifically, the locking tab and the securing means define a unique locking mechanism for joining the guide panel to the remainder of the base material without adhesives. The locking tab includes a strap extending from the guide panel, and a locking tab head connected to the strap. The securing means comprises generally a slot provided through the remainder of the base material which is dimensioned to permit passage of the strap and the locking head therethrough, and an aperture adjacent the slot which has slightly smaller dimensions than the locking tab head.

In use, the locking tab head and the strap are passed through the slot, and then the strap is bent to place the locking tab head next to the aperture. The locking tab head is then pushed through the aperture in a manner deforming the locking tab head as it passes through the aperture, but permitting the locking tab head to resiliently resume a shape having dimensions larger than those of the aperture. In the illustrated embodiment, the locking tab heads are provided a plurality of nodules about their outer periphery, the base of the nodules being positioned to easily pass through the adjacent aperture. The nodules, however, have sufficient length and rigidity to resist reverse passage through the aperture when the pushing force is removed. Further, a locking tab anchor hinged to one side of the aperture, is provided. This anchor engages the locking tab head after it is pushed through the aperture to prevent its passage back through the aperture.

Once the base material has been unfolded and properly constructed to form the rigid drain stand, the enclosure means or bag is passed from the bottom of the stand through its interior between the interior support panels, and the upper open end of the bag is stretched over the upper edge of the stand. Fluid can then be drained into the bag, and upon completion of the draining operation, the bag can be conveniently removed from the stand, sealed, and transported to a recycling station. If done properly, there is no clean-up of oil from the stand.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 1 is a perspective view of a preferred form of the fluid collection and disposal apparatus of the present invention, illustrating the apparatus as it may be used to collect oil draining from an engine crankcase;

FIG. 2 is an elevational view of a generally rectangular piece of flat, rigid base material from which a drain stand of the present invention is constructed, the base material being shown as folded along a mirror-image fold line;

FIG. 3 is an elevational view of the sheet of base material illustrated in FIG. 2, showing the manner in which that folded base material is cut to form the collapsible drain stand for holding a bag in a manner facilitating the flow of fluids to be collected into the bag;

FIG. 4 is an end view of the drain stand in a collapsed configuration, taken generally along the line 4—4 of FIG. 3;

FIG. 5 is an elevational view of the base material similar to that illustrated in FIG. 2, but illustrating the base material in an unfolded condition;

FIG. 6 is an elevational view of the unfolded base material illustrated in FIG. 5, showing how that base material would be cut to form the drain stand of the present invention prior to being folded along the mirror-image fold line;

FIG. 7 is an enlarged top plan view of the collapsible drain stand of FIGS. 2–6, illustrating the manner in which the drain stand is constructed by pulling apart opposite sides of the base material, and folding a pair of oppositely situated inner support panels upwardly into the interior of the drain stand;

FIG. 10 is a bottom plan view taken generally along the line 10—10 of FIG. 9;

FIG. 11 is an elevational sectional view taken generally along the line 11—11 of FIG. 9, and further illustrating the manner in which a fluid impermeable bag is positioned on the drain stand for collecting fluids;

FIG. 12 is an enlarged plan view of a locking tab;

FIG. 13 is an enlarged plan view of a portion of the drain stand which, in connection with the locking tab illustrated in FIG. 12, forms a unique locking mechanism for joining a first member to a second member without adhesives;

FIG. 14 is an enlarged sectional view taken generally along the line 14—14 of FIG. 10, illustrating with particularity the manner in which the locking tab is inserted into the side of the drain stand;

FIG. 15 is an elevational view taken generally along the line 15—15 of FIG. 14; and FIG. 16 is an enlarged perspective view of a perferred manner of tying off the upper open end of a fluid collection bag to prevent fluid leakage.

DETAILED DESCRIPTION OF THE PREFERRED EMBODIMENT

Figure 8:
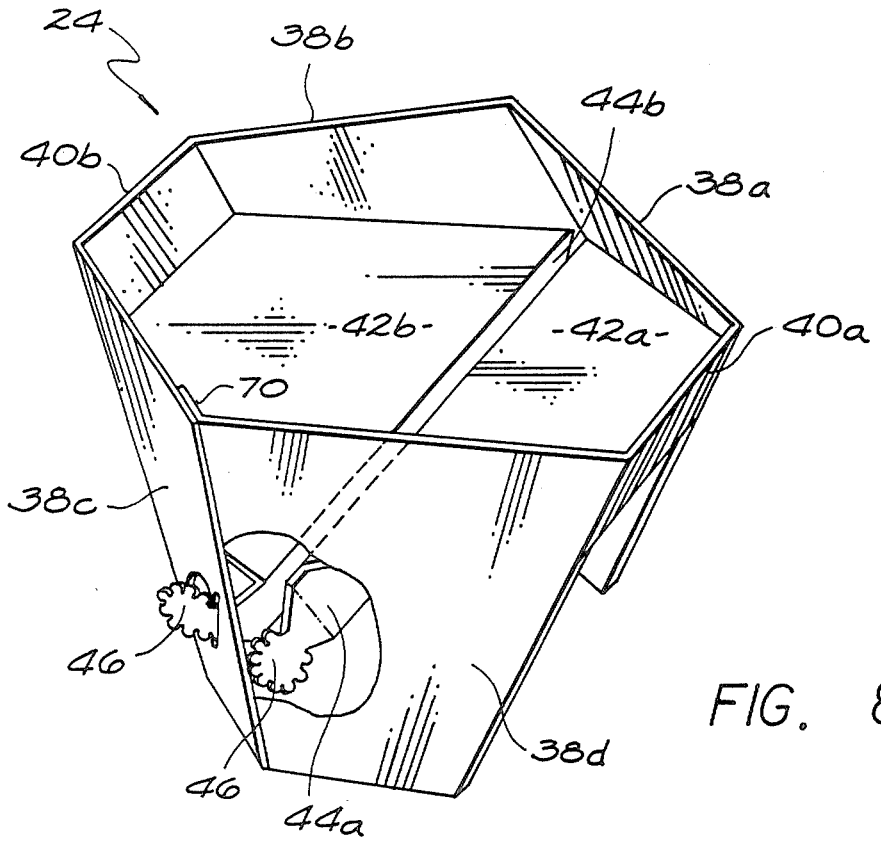
FIG. 8 is a perspective view illustrating assembly of the collapsible drain stand, specifically showing the manner in which locking tabs are inserted through adjacent slots for positioning the inner support panels.

As shown in the drawings for purposes of illustration, the present invention is concerned with a novel fluid collection and disposal apparatus, generally designated in FIG. 1 by the reference number 20. This improved fluid collection and disposal apparatus 20 comprises a fluid impermeable plastic bag 22, and a collapsible drain stand 24 for holding the bag 22 in a manner facilitating flow of fluid to be collected into the bag. To this end, the drain stand 24 includes means for engaging the open end 26 of the bag 22 to hold it in an open, fluid receiving position. Additionally, means are provided for funneling fluid drained through the open end 26, to the remainder of the bag 22 in a manner preventing larger solid objects from entering the bag. Further, means are provided for positioning the drain stand 24 in an appropriate position beneath a drain.

The improved fluid collection and disposal apparatus 20 of this invention is designed to be shipped in a flat condition, unfolded quickly for use, and is inexpensive to the degree that it is ultimately disposable. It is preferred that the drain stand 24 be constructed from a generally rectangular piece of flat, rigid base material which, in connection with the bag 22, provides an apparatus which is convenient to use, and which provides a safe and efficient means for properly disposing of fluids such as engine crankcase oil.

In accordance with the present invention, and as best illustrated in FIGS. 1 and 9–16, the bag 22 is preferably constructed of flexible polyethylene to have a tubular gusseted design. When intended for use in the collection and disposal of engine crankcase oil, the bag 22 should have approximately a ten quart volumetric capacity to accommodate virtually all anticipated applications. The drain stand 24 is preferably constructed of a corrugated fiberboard material having a one sixteenth inch cross-sectional dimension. It has been found that such material exhibits all the necessary structural capabilities for convenient and reliable use, yet it is durable enough to withstand the stresses and strains normally imposed on the drain stand 24 during normal use. Further, it should be understood that other materials may be used for the drain stand 24, such as double weight gauge chipboard or resilient plastic sheeting.

As shown in FIG. 1, the illustrated fluid collection and disposal apparatus 20 may be used to conveniently collect oil 28 drained from an oil pan 30 beneath an automobile (not shown) through a drain 32. The open end 26 of the bag 22 is stretched over the upper edge of the drain stand 24 in order to collect the oil 28 as it flows from the drain 32. The drain stand 24 is constructed so that the bag may extend downwardly through the interior 34 of the drain stand 24, and outwardly from the drain stand as needed to accommodate the length of the bag 22.

Figure 9:
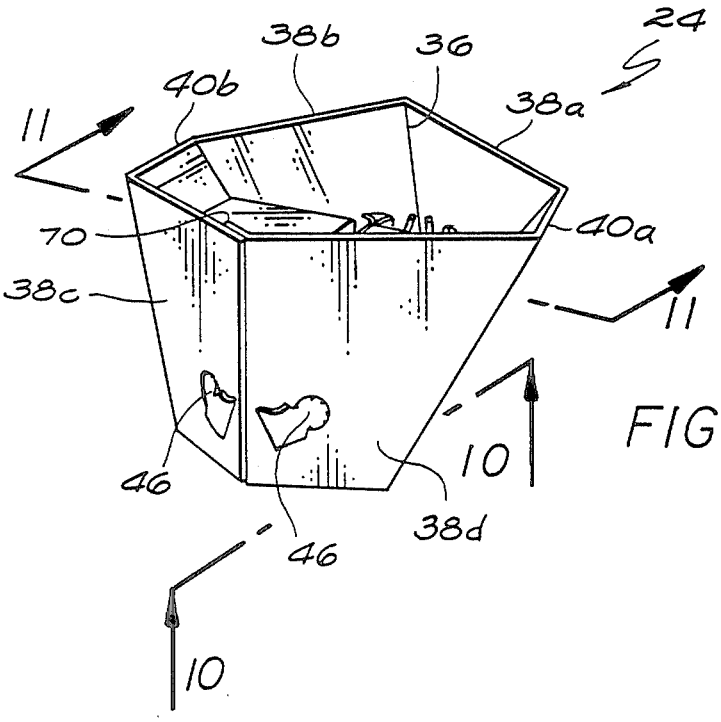
FIG. 9 is another perspective view of the collapsible drain stand, illustrating the manner in which the locking tabs are secured in place to complete assembly of the drain stand.

Referring now more particularly to FIGS. 9–11, the drain stand 24 is preferably constructed of a single rectangular piece of base material folded along a mirror-image fold line 36, and having its free ends glued to one another. The drain stand 24 includes four side wall panels 38*a–d*, and a pair of end wall panels 40*a* and 40*b* situated between two of the side wall panels 38. These side wall panels 38*a–d* provide the primary ground support for the fluid collection and disposal apparatus 20, and function as drain stand legs. These side wall panels 38*a–d*, together with the end wall panels 40*a* and 40*b*, further form the upper edge of the drain stand 24, which engages the bag 22 in a manner more fully described below.

The drain stand 24 additionally includes a pair of inner support panels 42*a* and 42*b* which are attached and extend downwardly from a respective one of the end wall panels 40*a* and 40*b*. These inner support panels 42*a* and 42*b* slope downwardly from the respective end wall panel 40*a* or 40*b*, and inwardly toward one another to create a trough sufficiently wide to permit fluid to flow easily therethrough, yet narrow enough to prevent larger solid objects from falling therethrough. Where it is intended that engine oil 28 will be the primary fluid collected by the fluid collection and disposal apparatus 20, the trough would be sized to permit the liquid oil to easily flow through the trough, and yet narrow enough to prevent a drain plug (not shown) from falling past the inner support panels 42*a* and 42*b*.

Attached to the lower edge of the inner support panels 42*a* and 42*b* are disposal bag guide panels 44*a* and 44*b* which facilitate passage of the open end 26 and adjacent portions of the bag 22 through the trough from the lower side of the drain stand 24. These guide panels 44*a* and 44*b* extend downwardly and slightly outwardly from their attachment point to the inner support panels 42*a* and 42*b* as best shown in FIG. 11.

Each lateral end of these guide panels 44*a* and 44*b* support a locking tab 46 which includes a strap portion 48, a narrowed locking tab neck portion 50, and a locking tab head 52. The locking tab head 52 further includes a solid circular base portion 54, and a plurality of nodules 56 which extend outwardly from the base portion 54. These locking tabs 46 interact with a corresponding slot 58 through an adjacent side wall panel 38, and a locking tab anchor 60 hinged to an aperture 62 situated near the slot 58.

The drain stand 24 can be conveniently manufactured utilizing two alternate preliminary methods. The first, illustrated in FIGS. 2–4 requires that a single rectangular piece of base material 64 be folded along the mirror-image fold line 36 (which is perpendicular to the long axis of the base material), to place the opposite free ends 66 and 68 of the base material 64 generally adjacent one another. One free end 68 is provided an attachment panel 70 intended to facilitate attachment of the free ends 66 and 68 by a glue adhesive or the like. The mirror-image fold line 36 provides a reference from which the base material 64 is cut and folded, whereby a cut or fold on one side of the mirror-image fold line is generally duplicated on the other side. The folding of the base material 64 prior to any cutting thereof ensures the creation of a symmetrical drain stand 24.

After the base material 64 has been so folded and the free ends 66 and 68 attached to one another, the base material is then cut and stamped in a single operation to form the various elements of the drain stand 24 described above. More particularly, a pair of cuts 72 would be made to separate the inner support panels 42 from the side wall panels 38. Further cuts would be made to create the slots 58, the apertures 62 and the locking tabs 46. To facilitate assembly of the drain stand 24, several fold lines are also provided.

Specifically, a fold line 74 is provided between the end wall panels 40 and the inner support panels 42. Further, fold lines 76 define the boundary between the end wall panels 40 and the side wall panels 38. Additional fold lines 78 and 80 are provided between the inner support panels 42 and the guide panels 44, and also between the guide panels 44 and the locking tabs 46.

As illustrated in FIGS. 5 and 6, however, the cutting of the base material 64 need not take place after the base material has been folded about the mirror-image fold line 36. Rather, the base material 64 can be cut while still unfolded, and then subsequently folded along the mirror-image fold line 36. The free ends 66 and 68 may also be subsequently attached together with the attachment panel 70.

With reference now to FIG. 7, after the base material 64 has been folded, cut, and its free ends 66 and 68 attached to one another, the two opposing sides of the base material 64 are separated from one another in a manner spacing the end wall panels 40*a* and 40*b* from one another, but leaving the side wall panels 38*a* and 38*b*, and the side wall panels 38*c* and 38*d* attached to one another. This separation of the two opposing sides of the base material 64 effectively creates a definable interior 34 of the drain stand 24. The inner support panels 42 would then be bent upwardly and inwardly along their fold line 74 with the end wall panels 40 to create the trough mentioned earlier.

The inner support panels 42 are rigidly positioned by inserting the locking tab head 52, the neck portion 50 and the strap portion 48 of the locking tab 46 through the adjacent slot 58 (FIG. 8). Once fully inserted, the locking tab 46 is bent along the fold line 80 to place the locking tab head 52 next to the aperture 62. The locking tab head 52 is then pushed through the aperture 62 in a manner deforming the locking tab head as it passes through the aperture, but permitting the locking tab head to resiliently resume a shape having dimensions larger than those of the aperture after passing therethrough. This is facilitated by the provision of the nodules 56 which tend to easily pass through the aperture 62, but because their diametric dimension is greater than that of the aperture 62, they resist being withdrawn back through the aperture. To further ensure that the locking tab head 52 remains within the aperture 62, the locking tab anchor 60 engages a face 82 of the locking tab head 52 in the manner illustrated in FIGS. 14 and 15.

After the drain stand 24 has been so constructed, the bag 22 is then preferably drawn through the bottom of the drain stand between the oppositely facing guide panels 44*a* and 44*b*. The open end 26 of the plastic bag 22 is then preferably stretched over the upper end of the drain stand 24 as illustrated in FIGS. 1 and 11. Since the side wall panels 38 provide drain stand legs effectively elevating the inner support panels 42 above the supporting surface, the bag 22 may conveniently extend between these legs outwardly from the drain stand 24 in a manner conveniently accommodating bags 22 of varying lengths. Oil or other fluids may then be conveniently drained through the open end 26 of the plastic bag 22 as illustrated in FIG. 1.

After the oil has been completely drained, the drain plug (not shown) would typically be replaced into the drain 32, the portion of the plastic bag 22 adjacent its open end 26 pulled upwardly and over the upper surface of the drain stand 24, and then the bag 22 would be carefully pulled downwardly through the trough between the guide panels 44*a* and 44*b* and the opposing ends of the inner support panels 42*a* and 42*b* to remove the bag from the drain stand 24. This bag 22 could then be conveniently sealed and transported to an appropriate disposal site, such as an oil recycling center, for disposal in a safe, convenient and ecologically sound manner.

As illustrated in FIG. 16, one method of sealing off the open end 26 of the bag 22 would be to twist the bag to form a rope-type effect, then tie an overhand knot into that upper portion of the plastic bag. Above the overhand knot the roped portion of the bag could then be doubled over and then secured by a tie strap 84 having a securing mechanism 86 which interacts with small rachet teeth 88.

From the foregoing it is to be appreciated that the fluid collection and disposal apparatus 20 of the present invention can be inexpensively manufactured, is convenient to use, and provides a safe and efficient means for properly disposing hazardous waste fluids, such as engine crankcase oil. The apparatus 20 can be shipped in a flat condition, unfolded quickly for use, and lends itself well to promotional uses by manufacturers in connection with other types of goods. In this regard, it should be apparent that the base material 64, either before or after the cutting and stamping procedure, can be printed with a manufacturer's logo or other advertisements. Additionally, the novel apparatus described eliminates the clean up of parts after the oil has been drained, and provides a very convenient means for transporting the oil to a recycling center.

Although a particular embodiment of the invention has been described in detail for purposes of illustration, various modifications may be made without departing from the spirit and scope of the invention. Accordingly, the invention is not to be limited, except as by the appended claims.

I claim:

1. A method of funneling fluid to be collected into a fluid impermeable bag-like enclosure means, the method comprising the step of making a collapsible drain stand for holding the fluid impermeable bag-like enclosure means in a manner facilitating flow of the fluid to be collected into the enclosure means, from a generally rectangular piece of flat, rigid-but-bendable base material, the steps of making the drain stand comprising:

establishing a mirror-image fold line perpendicular to the long axis of the base material, the mirror-image fold line providing a reference from which the base material is cut and folded, whereby a cut or fold on one side of the mirror-image fold line is generally duplicated on the other side of the mirror-image fold line;

cutting the bottom side of the base material to form, on each side of the mirror-image fold line, a pair of drain stand legs, an enclosure means guide panel, and a locking tab on each end of the guide panel;

cutting the mid-section of the base material to form, on each side of the mirror-image fold line, an inner support panel connected at its upper end to the remainder of the base material but separated along its sides from the base material, the inner support panel further being connected at its lower end to the guide panel in a manner whereby the guide panel and its locking tabs are supported solely by the inner support panel;

providing, on each side of the mirror-image fold line, means for interacting with a respective one of the locking tabs to securely position the locking tabs therein;

folding the base material along the mirror-image fold line and connecting the opposite free ends of the base material to one another;

separating the two sides of the base material from one another while leaving them attached to each other at their respective ends, the step of separating the sides of the base material creating a definable drain stand interior;

bending the inner support panels upwardly into the drain stand interior to create means for funneling fluid to be drained through the drain stand; and securing the inner support panels in a desired position by engaging the locking tabs with the respective interacting means.

2. A method of funneling fluid as set forth in claim 1, wherein the step of folding the base material along the mirror-image fold line and connecting the opposite free ends of the base material to one another, takes place before any of the cutting or other folding steps.

3. A method of funneling fluid as set forth in clain 1, wherein the step of folding the base material along the mirror-image fold line and connecting the opposite free ends of the base material to one another, takes place after the cutting steps but before any of the other folding steps.

4. A method of funneling fluid as set forth in claim 1, wherein an end attachment panel is provided along one end of the base material to facilitate the connecting of the opposite free ends of the base material to one another.

5. A method of funneling fluid as set forth in claim 1, including the steps of creating, on each side of the mirror-image fold line, additional fold lines at the upper end of the inner support panel between the inner support panel and the remainder of the base material, and between the inner support panel and the guide panel, and further creating, on each side of the mirror-image fold line, other fold lines extending upwardly from the fold line at the upper end of the inner support panel, to define an end panel above the inner support panel, the end panel forming a portion of the remainder of the base material.

6. A method of funneling fluid as set forth in claim 1, wherein the step of securing the inner support panels includes the step of folding the guide panels downwardly with respect to the inner support panels and positioning the lower ends of the inner support panels with respect to each other to create a trough sufficiently wide to permit fluid flow therethrough, yet narrow enough to prevent larger solid objects from falling therethrough.

7. A method of funneling fluid to be drained into a fluid impermeable bag-like enclosure means, the method comprising the steps of making a foldable drain stand for supporting the fluid impermeable bag-like enclosure means and positioning open end of the enclosure means below a drain, the drain stand being constructed from a piece of flat, bendable base material having opposite free ends, the steps of making the drain stand comprising:

establishing a mirror-image fold line which provides a reference from which the base material is cut and folded, whereby a cut or fold on one side of the mirror-image fold line is generally duplicated on the other side of the mirror-image fold line;

cutting a first side of the base material to form, on each side of the mirror-image fold line, a pair of drain stand legs;

cutting the base material to form, on each side of the mirror-image fold line, an inner support panel connected at one end to the remainder of the base material but otherwise separated form the base material;

folding the base material along the mirror-image fold line and connecting the opposite free ends of the base material to one another to form two adjacent, flat sides of base material;

separating the two sides of the base material from one another while leaving them attached to each other at their respective ends, the step of separating the sides of the base material creating a definable drain stand interior;

bending the inner support panels upwardly into the drain stand interior to create means for funneling fluid to be drained through the drain stand; and securing the inner support panels in a desired position.

8. A method of funneling fluid as set forth in claim 7, wherein the step of folding the base material along the mirror-image fold line and connecting the opposite free ends of the base material to one another, takes place before any of the cutting or other folding steps.

9. A method of funneling fluid as set forth in claim 7, wherein the step of folding the base material along the mirror-image fold line and connecting the opposite free ends of the base material to one another, takes place after the cutting steps but before any of the other folding steps.

10. A method of funneling fluid as set forth in claim 7, including the steps of cutting the base material to form on each side of the mirror image fold line an enclosure means guide panel having two ends which each support a locking tab, which guide panel and its locking tabs are supported solely by an inner support panel, the method further including the step of providing, on each side of the mirror-image fold line, means for interacting with a respective one of the locking tabs to securely position the locking tabs therein.

11. A method as set forth in claim 10, wherein the step of securing the inner support panels includes the step of folding the guide panels downwardly with respect to the inner support panels, and positioning the ends of the inner support panels connected to the guide panels, with respect to each other, to create a through sufficiently wide to permit fluid flow therethrough, yet narrow enough to prevent larger solid objects from falling therethrough.

12. A method as set forth in claim 11, including the step of creating, on each side of the mirror-image fold line, additional fold lines between the inner support panels and the remainder of the base material, and between the inner support panels and the guide panels, and further creating, on each side of the mirror-image fold line, an end panel which separates the pair of drain stand legs.

13. A method of funneling fluid to be drained into a fluid impermeable bag-like enclosure means, the method comprising the steps of making a foldable drain stand for supporting the fluid impermeable bag-like enclosure means and positioning an open end of the enclosure means adjacent a drain, the drain stand being constructed of a flat, bendable base material including a pair of base components each having two opposite ends, which base components, in use, are connected to each other at their ends, the steps of making the drain stand comprising:

cutting the base material to form a pair of drain stand legs in each base component;

cutting the base material to form an inner support panel connected at one end to the remainder of the base material but otherwise separated from the base material;

separating the two base components from one another while leaving them attached to each other at their respective ends, the step of separating the base components creating a definable drain stand interior;

bending the inner support panel upwardly into the drain stand interior to create means for funneling fluid to be drained through the drain stand; and securing the inner support panel in a desired position.

14. A method of funneling fluid as set forth in claim 13, wherein the cutting steps include the forming of a collecting means guide panel having two ends and a locking tab on each end of the guide panel, wherein the guide panel and its locking tabs are supported solely by the inner support panel.

15. A method of funneling fluid as set forth in claim 14, including the step of providing means for interacting with a respective one of the locking tabs to securely position the locking tabs therein, wherein during the securing step the locking tabs engage the respective interacting means.

16. A method of funneling fluid as set forth in claim 14, wherein the step of securing the inner support panel includes the step of folding the guide panel downwardly with respect to the inner support panel and positioning the fold line between the guide panel and inner support panel to create a trough sufficiently wide to permit flow therethrough, yet narrow enough to prevent larger solid objects from falling therethrough.

17. A method of making a fluid collection and disposal apparatus, the method comprising the following steps:

providing a fluid impermeable bag-like enclosure means for receiving and holding fluids to be collected, the enclosure means having an open end;

providing a drain stand which is folded flat for shipping and packaging;

unfolding the drain stand; and holding the enclosure means in a manner facilitating the flow of the fluid to be collected into the enclosure means; and wherein the unfolded drain stand includes a primary body portion which forms a continuous outer perimeter of the unfolded drain stand and defines a drain stand interior, and an inner support panel attached to the primary body portion, which inner support panel is inclined downwardly into the drain stand interior, wherein the primary body portion provides means for engaging the open end of the enclosure means in an open, fluid receiving position, and wherein the inner support panel provides means for funneling the fluid drained through the enclosure means open end to the remainder of the enclosure means in a manner preventing larger solid objects which may enter the open end of the enclosure means from passing by the funneling means into the remainder of the enclosure means.

* * * * *